US008926204B1

(12) United States Patent
D'Ignazio

(10) Patent No.: US 8,926,204 B1
(45) Date of Patent: Jan. 6, 2015

(54) LIQUID SANITIZER DISPENSER SYSTEM

(76) Inventor: Kathy L. D'Ignazio, Hamilton (CA)

( * ) Notice: Subject to any disclaimer, the term of this patent is extended or adjusted under 35 U.S.C. 154(b) by 860 days.

(21) Appl. No.: 13/117,441

(22) Filed: May 27, 2011

Related U.S. Application Data

(60) Provisional application No. 61/351,090, filed on Jun. 30, 2010, provisional application No. 61/452,397, filed on Mar. 14, 2011.

(51) Int. Cl.
*A46B 11/00* (2006.01)

(52) U.S. Cl.
USPC ..... 401/10; 401/131; 401/196; 401/206; 604/2

(58) Field of Classification Search
USPC ..... 401/9, 10, 131, 205, 206, 196; 604/1, 2
See application file for complete search history.

(56) References Cited

U.S. PATENT DOCUMENTS

| | | | | |
|---|---|---|---|---|
| 2,055,314 | A * | 9/1936 | Seburger | 401/10 |
| 2,788,537 | A * | 4/1957 | Greenberg | 401/10 |
| 3,759,621 | A * | 9/1973 | De Carlo | 401/10 |
| 4,347,010 | A * | 8/1982 | Petkoff | 401/10 |
| 5,222,268 | A * | 6/1993 | Snodgrass | 15/29 |
| 5,308,181 | A * | 5/1994 | Hull et al. | 401/206 |
| 6,371,675 | B1 * | 4/2002 | Hoang et al. | 401/205 |
| 6,425,701 | B1 * | 7/2002 | Jacobs | 401/6 |
| 6,558,060 | B1 * | 5/2003 | Raju | 401/10 |
| 6,726,385 | B1 * | 4/2004 | Borowski | 401/6 |
| 7,350,994 | B2 * | 4/2008 | Meert | 401/10 |
| 8,226,317 | B2 * | 7/2012 | Uxa, Jr. | 401/265 |
| 2006/0239755 | A1 * | 10/2006 | Kremizis | 401/131 |
| 2007/0258750 | A1 * | 11/2007 | Parlionas | 401/131 |
| 2008/0015484 | A1 * | 1/2008 | Wolfensberger | 604/2 |
| 2010/0303536 | A1 * | 12/2010 | Geesbreght et al. | 401/196 |

* cited by examiner

*Primary Examiner* — David Walczak
*Assistant Examiner* — Bradley Oliver
(74) *Attorney, Agent, or Firm* — Neustel Law Offices

(57) ABSTRACT

A liquid sanitizer dispenser system for efficiently dispensing a liquid sanitizer. The liquid sanitizer dispenser system generally includes a first dispenser, and a second dispenser pivotally connected to the first dispenser via a hinge. The first dispenser and the second dispenser include a plurality of first apertures and a plurality of second apertures within the inner surfaces respectively for dispensing the liquid sanitizer stored within the dispensers. The first dispenser and the second dispenser further include a first porous material and a second porous material attached to the inner surface of the dispensers respectively. Liquid flow control mechanisms are utilized to control the flow of liquid sanitizer through the apertures.

18 Claims, 10 Drawing Sheets

LIQUID SANITIZER DISPENSER SYSTEM

CROSS REFERENCE TO RELATED APPLICATIONS

I hereby claim benefit under Title 35, United States Code, Section 119(*e*) of U.S. provisional patent application Ser. No. 61/351,090 filed Jun. 3, 2010 and U.S. provisional patent application Ser. No. 61/452,397 filed Mar. 14, 2011. The 61/351,090 application and 61/452,397 application are both hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to liquid sanitizer dispensers and more specifically it relates to a liquid sanitizer dispenser system for efficiently dispensing a liquid sanitizer.

2. Description of the Related Art

Any discussion of the related art throughout the specification should in no way be considered as an admission that such related art is widely known or forms part of common general knowledge in the field.

Conventional sanitizer dispensers typically are comprised of bottle type containers with a nozzle that allows for dispensing of the liquid sanitizer (e.g. soap, antibacterial solution, antimicrobial solution). The nozzle may provide for a liquid stream or a liquid spray of the liquid sanitizer.

While conventional sanitizer dispensers are suitable for dispensing a volume of liquid sanitizer, they are not as suitable for applying the liquid sanitizer upon an object such as but not limited to a doorknob. Conventional sanitizer dispensers require the user to utilize an additional object to effectively apply the liquid sanitizer to the object such as a rag or sponge.

Because of the inherent problems with the related art, there is a need for a new and improved liquid sanitizer dispenser system for efficiently dispensing a liquid sanitizer.

BRIEF SUMMARY OF THE INVENTION

The invention generally relates to a liquid sanitizer dispenser which includes a first dispenser, and a second dispenser pivotally connected to the first dispenser via a hinge. The first dispenser and the second dispenser include a plurality of first apertures and a plurality of second apertures within the inner surfaces respectively for dispensing the liquid sanitizer stored within the dispensers. The first dispenser and the second dispenser further include a first porous material and a second porous material attached to the inner surface of the dispensers respectively.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
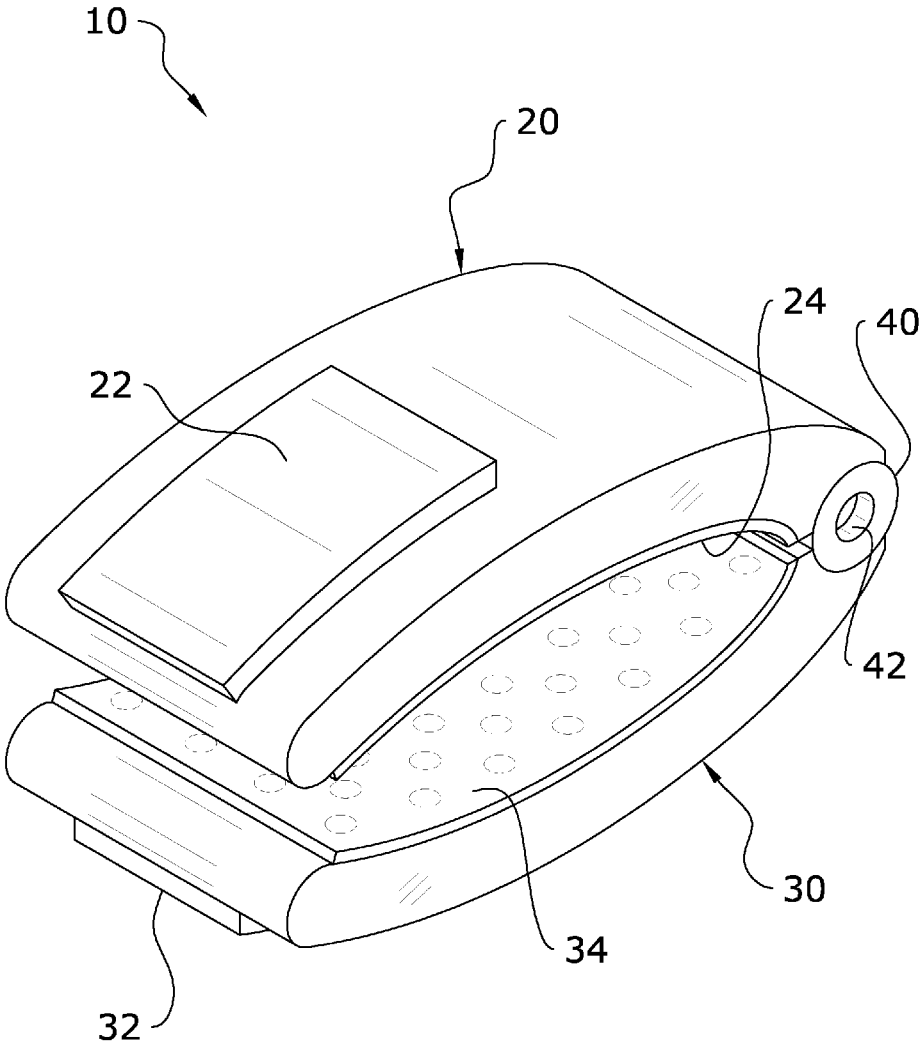
FIG. 1 is an upper perspective view of the present invention in a closed position.

Turning now descriptively to the drawings, in which similar reference characters denote similar elements throughout the several views, FIGS. 1 through 13 illustrate a liquid sanitizer dispenser system 10, which comprises a first dispenser 20, and a second dispenser 30 pivotally connected to the first dispenser 20 via a hinge 40. The first dispenser 20 and the second dispenser 30 include a plurality of first apertures 28 and a plurality of second apertures 38 within the inner surfaces respectively for dispensing the liquid sanitizer (e.g. soap, antibacterial solution, antimicrobial solution) stored within the dispensers 20, 30. The first dispenser 20 and the second dispenser 30 further include a first porous material 24 and a second porous material 34 attached to the inner surface of the dispensers 20, 30 respectively. Liquid flow control mechanisms are preferably utilized to control the flow of liquid sanitizer through the apertures 28, 38.

B. Dispensers

FIGS. 1 through 8 illustrate the first dispenser 20 which is adapted for receiving, storing and dispensing a volume of liquid sanitizer. The liquid sanitizer may be in any state of matter that is able to flow and disperse (e.g. gel).

Figure 4:
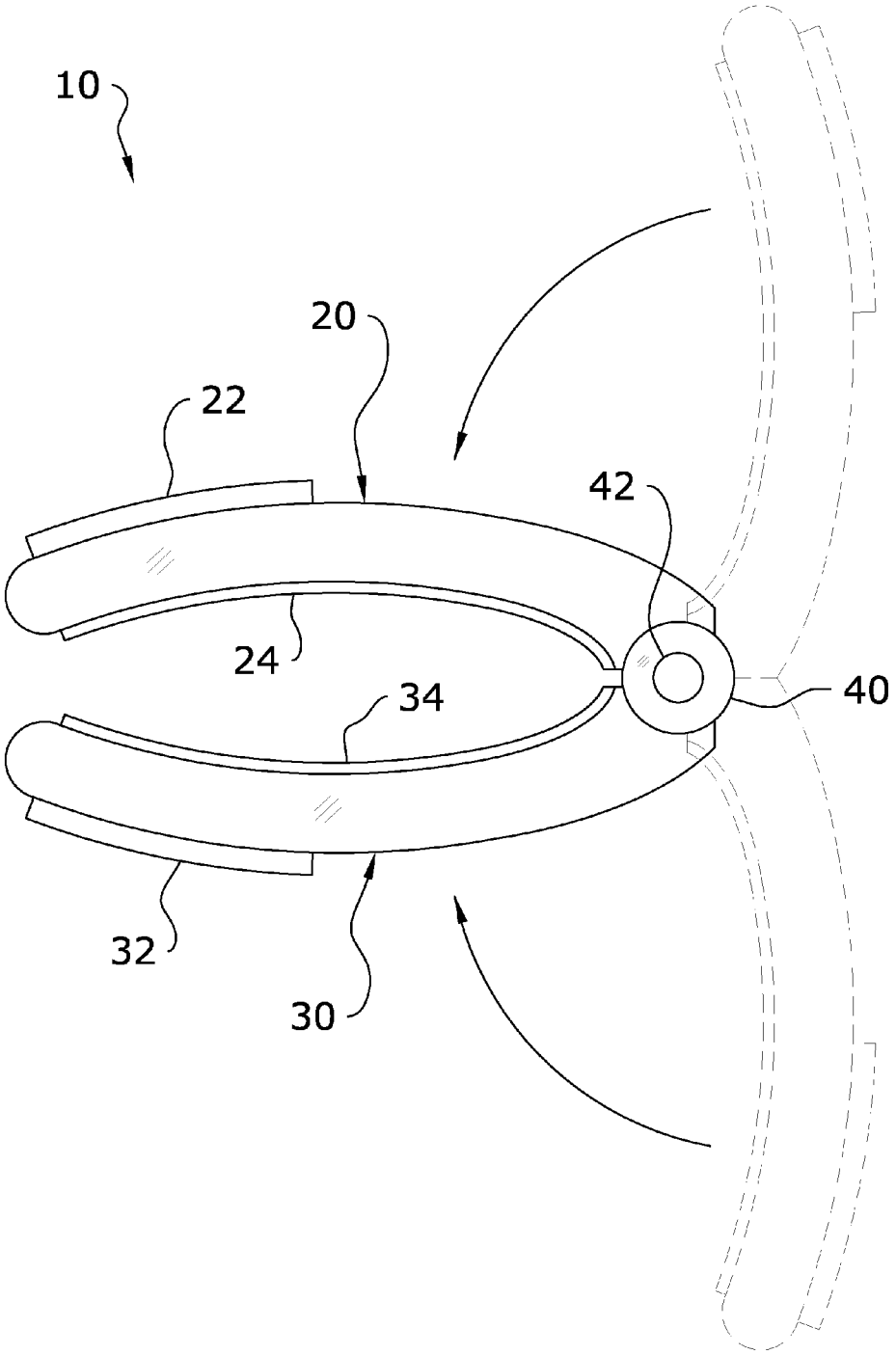
FIG. 4 is a side view of the present invention in the closed position.
Figure 5:
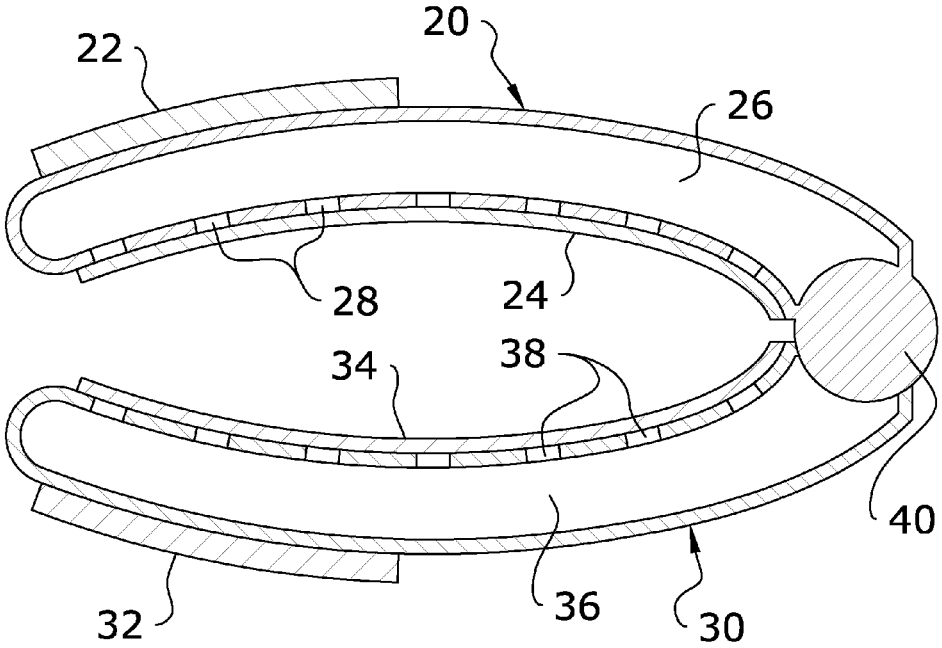
FIG. 5 is a side cutaway view of the present invention illustrating the reservoirs.
Figure 6:
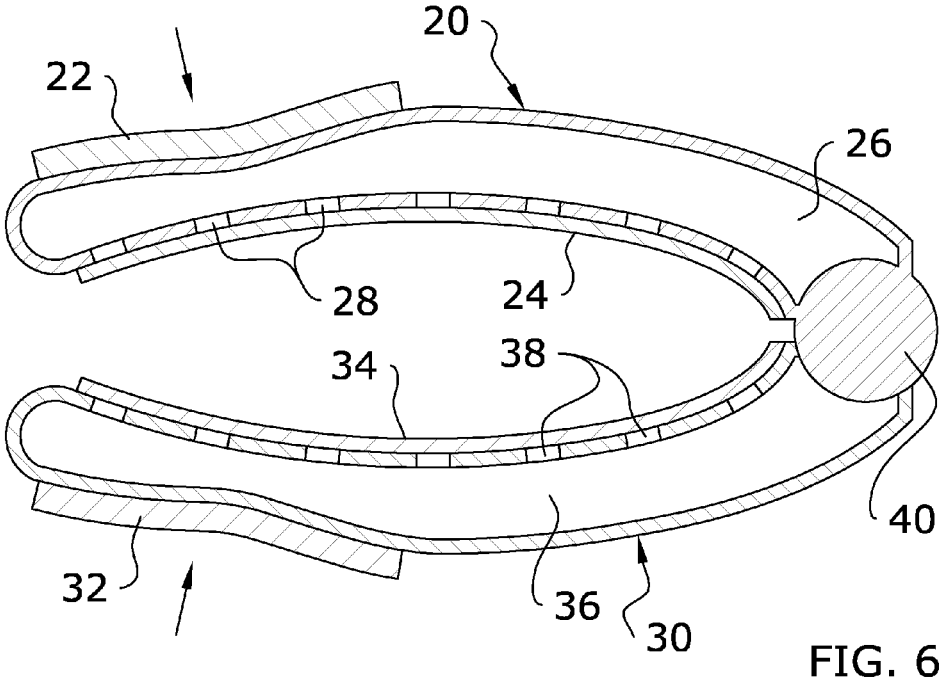
FIG. 6 is a side cutaway view illustrating the depressing of the grips to dispense the liquid sanitizer.

FIGS. 5 and 6 illustrate a first reservoir 26 within the first dispenser 20 for storing a volume of liquid sanitizer. The first dispenser 20 includes a first inner surface and a plurality of first apertures 28 extending through the first inner surface to the first reservoir 26 to allow the liquid sanitizer to be dispensed from. The first dispenser 20 is preferably comprised of a broad and curved structure wherein the first inner surface is preferably curved as best illustrated in FIGS. 1 through 4 of the drawings. As shown in the alternative embodiment of FIGS. 7 and 8, the first dispenser 20 includes a first flat portion 29 at an end portion opposite of the hinge 40 or other pivot point. The first dispenser 20 is preferably comprised of a resilient material that allows a user to depress thereby dispensing the liquid sanitizer from the first reservoir 26.

FIGS. 1 through 8 illustrate the second dispenser 30 which is adapted for receiving, storing and dispensing a volume of liquid sanitizer. FIGS. 5 and 6 illustrate a second reservoir 36 within the second dispenser 30 for storing a volume of liquid sanitizer. The second dispenser 30 includes a second inner surface and a plurality of second apertures 38 extending through the second inner surface to the second reservoir 36 to allow the liquid sanitizer to be dispensed from. The second dispenser 30 is preferably comprised of a broad and curved structure wherein the second inner surface is preferably curved as best illustrated in FIGS. 1 through 4 of the drawings. As shown in the alternative embodiment of FIGS. 7 and 8, the second dispenser 30 includes a second flat portion 39 at an end portion opposite of the hinge 40 or other pivot point. The second dispenser 30 is preferably comprised of a resilient material that allows a user to depress thereby dispensing the liquid sanitizer from the second reservoir 36.

Figure 2:
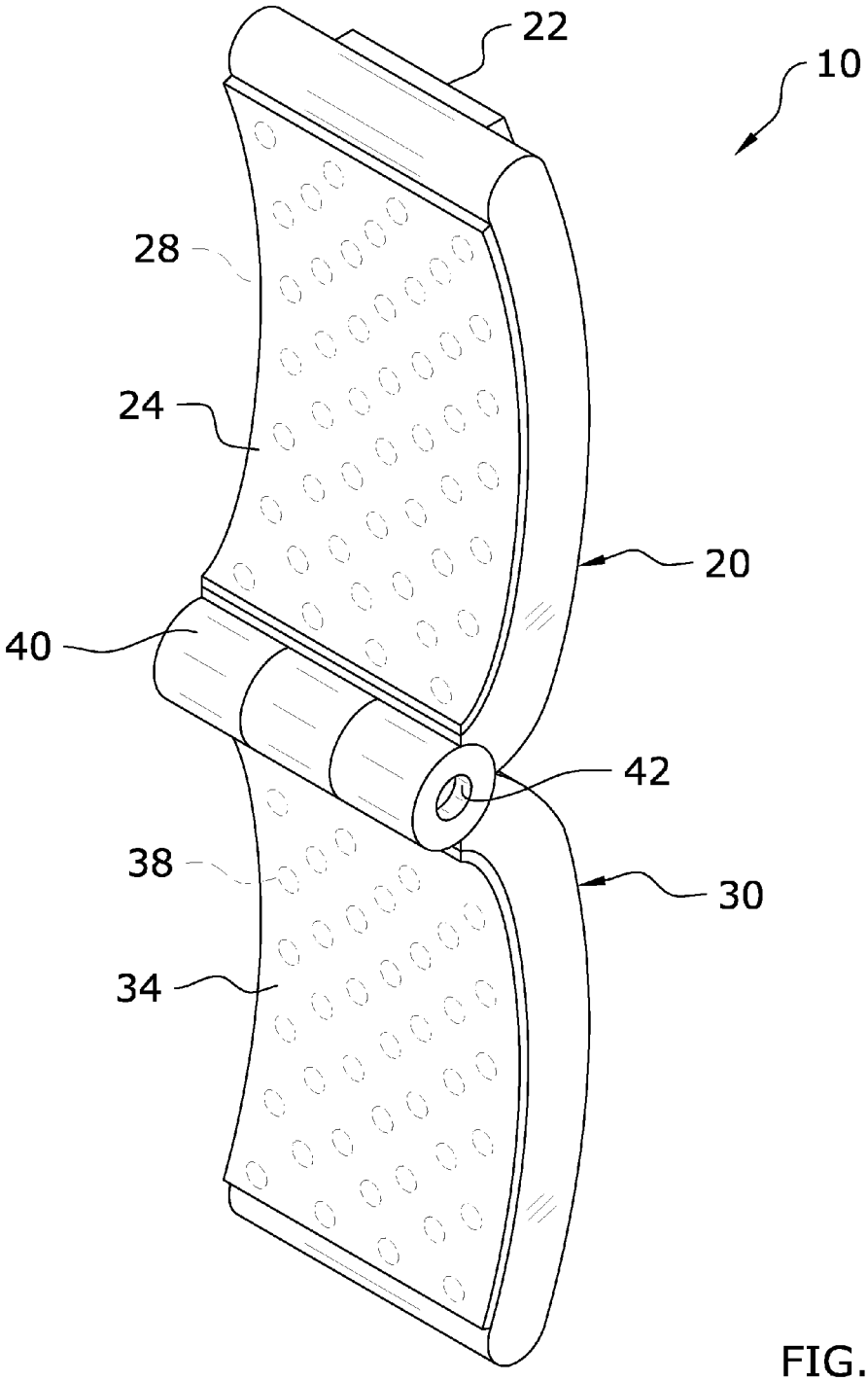
FIG. 2 is an upper perspective view of the present invention in an open position.
Figure 3:
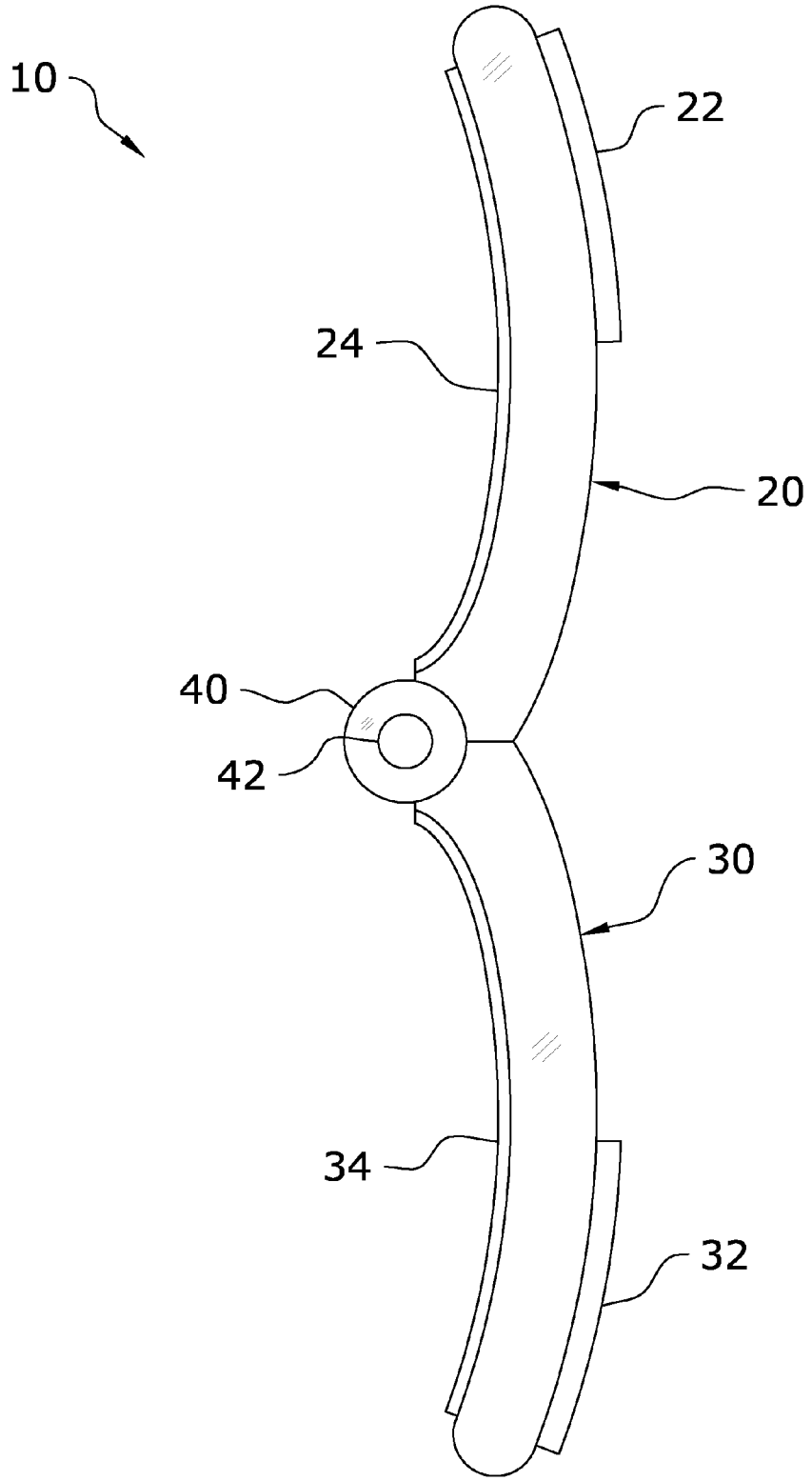
FIG. 3 is a side view of the present invention in the open position.

As illustrated in FIGS. 1 through 8 of the drawings, the first dispenser 20 preferably mirrors the shape, size and structure of the second dispenser 30. The outer surface of the dispensers 20, 30 is preferably curved forming an overall oval shaped structure when assembled and in the closed position as best illustrated in FIG. 4 of the drawings. The curvature of the inner surfaces of the dispensers 20, 30 is preferably sufficient to allow for flattening out upon flat surfaces when the dispensers 20, 30 are in the open position as illustrated in FIG. 3 of the drawings.

C. Hinge

The first dispenser 20 is pivotally connected to the second dispenser 30 to provide for an open position and a closed position. The dispensers 20, 30 may be directly connected to one another whereby the resiliency of the dispensers 20, 30 allows for pivoting of the dispensers 20, 30 with respect to one another.

However, it is preferred that the first dispenser 20 is pivotally connected to the second dispenser 30 by a hinge 40 connected between the first dispenser 20 and the second dispenser 30. The hinge 40 is preferably biased to retain the dispensers 20, 30 in the open position in a biased manner. In particular, the hinge 40 applies a biasing force to extend the dispensers 20, 30 outwardly from one another into a relatively overall flat structure as illustrated in FIG. 3 of the drawings. The biasing force may be applied via various mechanical devices such as but not limited to a spring. As shown in FIG. 3, the open position is preferably comprised of the first dispenser 20 extending away from the second dispenser 30. As illustrated in FIG. 4 of the drawings, the closed position is preferably comprised of the first dispenser 20 opposing the second dispenser 30 in a substantially parallel manner forming a U-shaped or C-shaped structure.

As illustrated in FIGS. 1 through 4 of the drawings, a refill aperture 42 extends within a side of the hinge 40 to allow for refilling of the reservoirs with liquid sanitizer. The refill aperture 42 is fluidly connected to the first reservoir 26 and the second reservoir 36 via refill passages within the hinge 40 that are fluidly connected between the refill aperture 42 and the reservoirs for refilling the reservoirs with liquid sanitizer with a refill container having a nozzle that fluidly mates with the refill aperture 42. The refill aperture 42 is comprised of a refill valve structure that automatically closes after refilling to prevent the liquid sanitizer from escaping the refill aperture 42 or alternatively a cap may be inserted into the refill aperture 42.

D. Porous Material

FIGS. 1 through 4 illustrate a first porous material 24 attached to the first inner surface of the first dispenser 20 and a second porous material 34 attached to the second inner surface of the second dispenser 30. The porous material 24, 34 receives the liquid sanitizer dispensed via the apertures 28, 38 and evenly spreads the liquid sanitizer to allow for application to a surface of an object (e.g. doorknob, table top). The porous material 24, 34 further prevents accidental dispensing of the liquid sanitizer when little or no pressure is applied to the dispensers 20, 30.

The porous material 24, 34 may be comprised of various types of porous material such as but not limited to sponge, artificial fiber sponge, foamed plastic polymers, low-density polyether, polyvinyl alcohol, polyester and the like. The porous material 24, 34 preferably are comprised of thin structures that preferably completely cover the inner surfaces of the dispensers 20, 30 as best illustrated in FIG. 2 of the drawings.

E. Grips

As illustrated in FIG. 1 through 8 of the drawings, a first grip 22 is preferably attached to a first outer surface of the first dispenser 20 and a second grip 32 is preferably attached to a second outer surface of the second dispenser 30. The grips 22, 32 allow for increased gripping with the fingers by the user and are preferably comprised of a gripping material such as but not limited to rubber and the like. The grips 22, 32 are preferably positioned on distal portions of the outer surfaces of the dispensers 20, 30 as best illustrated in FIGS. 3 through 8 of the drawings.

F. Extending/Retracting Device

Figure 8:
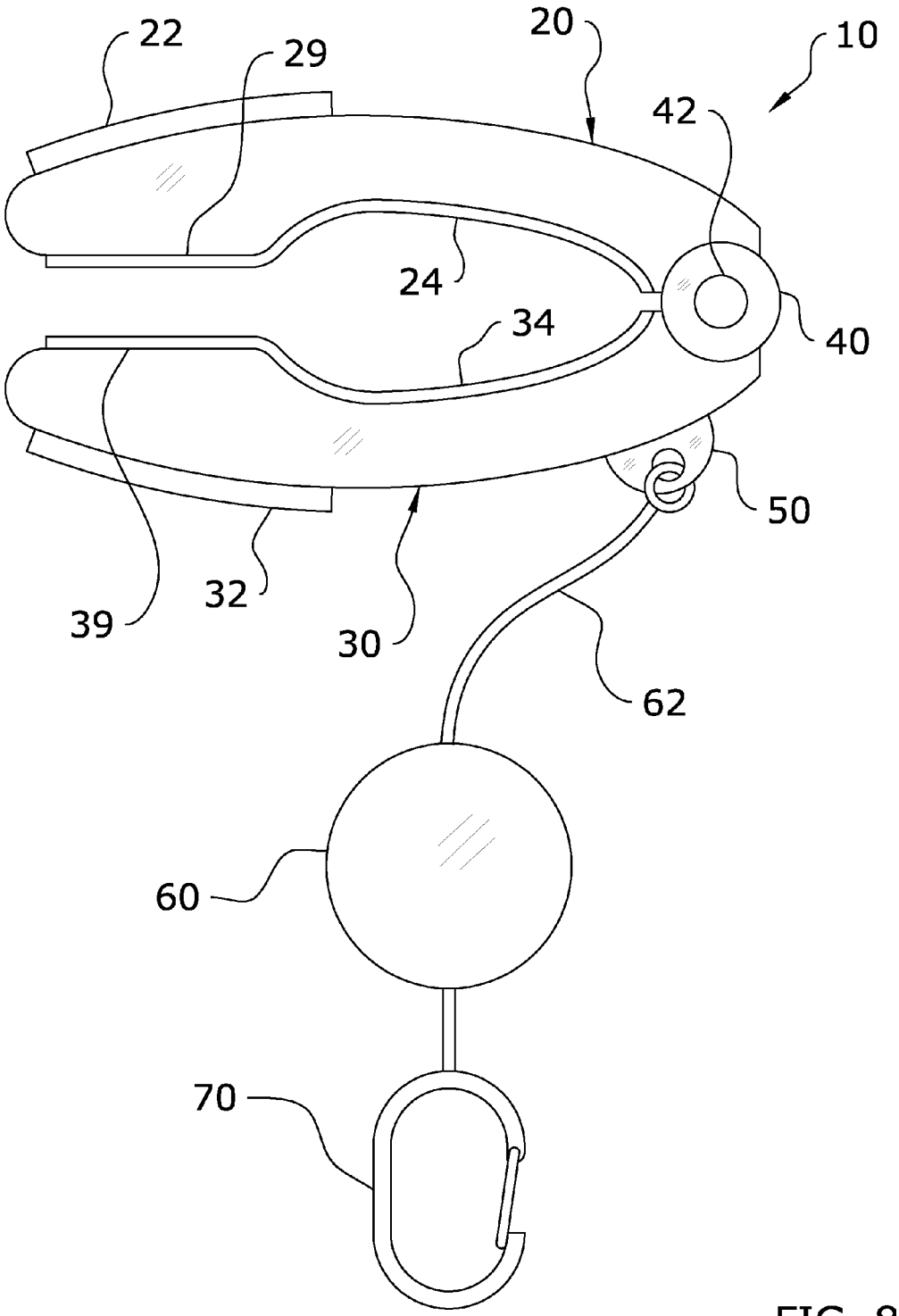
FIG. 8 is a side view of the first alternative embodiment connected to an extending/retracting device and a clip.

To assist in retaining the present invention with a user during use and non-use, a connecting member 50 is preferably attached to either the first dispenser 20 or the second dispenser 30. An extending/retracting device 60 including a tether 62 retractably extending therefrom is also provided that retractably dispenses the tether 62 from a housing. The tether 62 is connected to either the first dispenser 20 or the second dispenser 30 directly or connected to the connecting member 50 as illustrated in FIG. 8 of the drawings. A clip 70 is preferably attached to the extending/retracting device 60 to allow for attachment to a belt loop or other object on the user.

G. Liquid Flow Control Mechanisms

Figure 9:
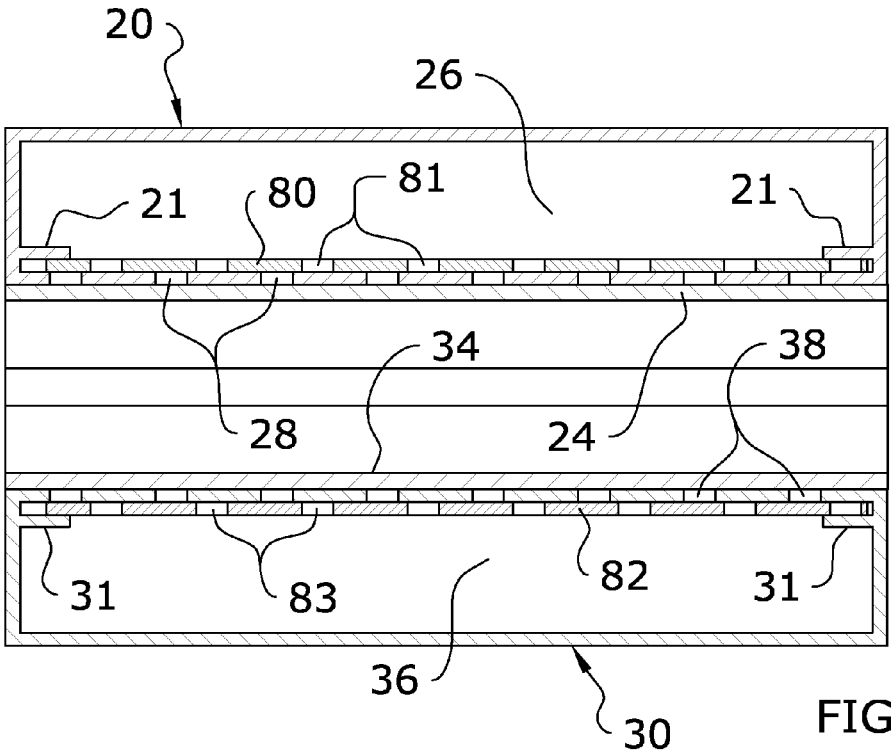
FIG. 9 is an end cutaway view illustrating a second alternative embodiment in a closed state utilizing a first control plate and a second slide plate slidably controlling flow of liquid sanitizer through the first apertures and second apertures respectively.
Figure 10:
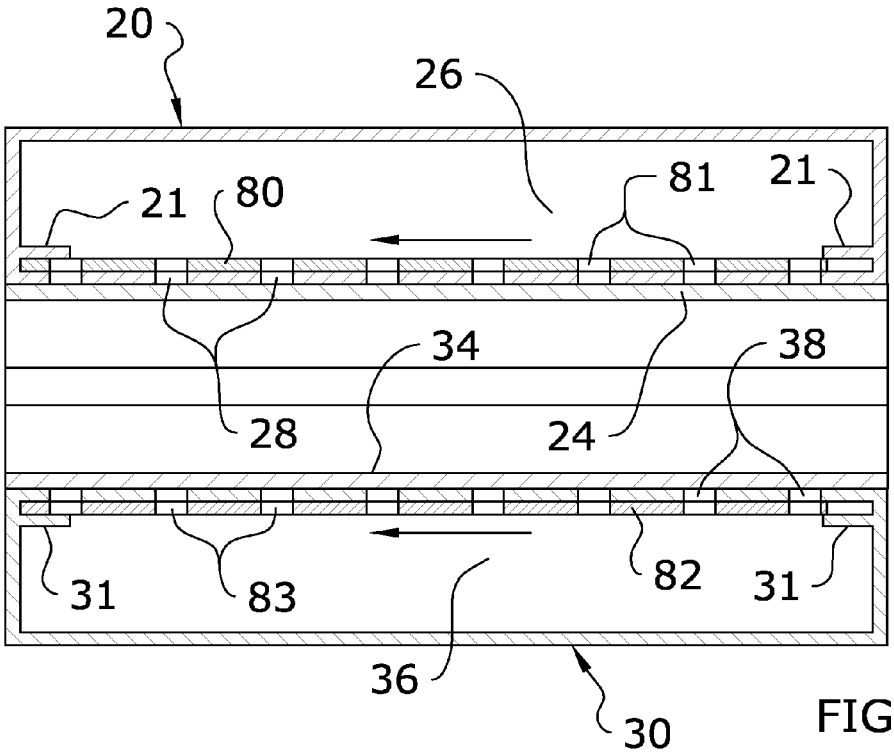
FIG. 10 is an end cutaway view illustrating the second alternative embodiment in an open state allowing the liquid sanitizer to flow through the first apertures and second apertures.
Figure 11:
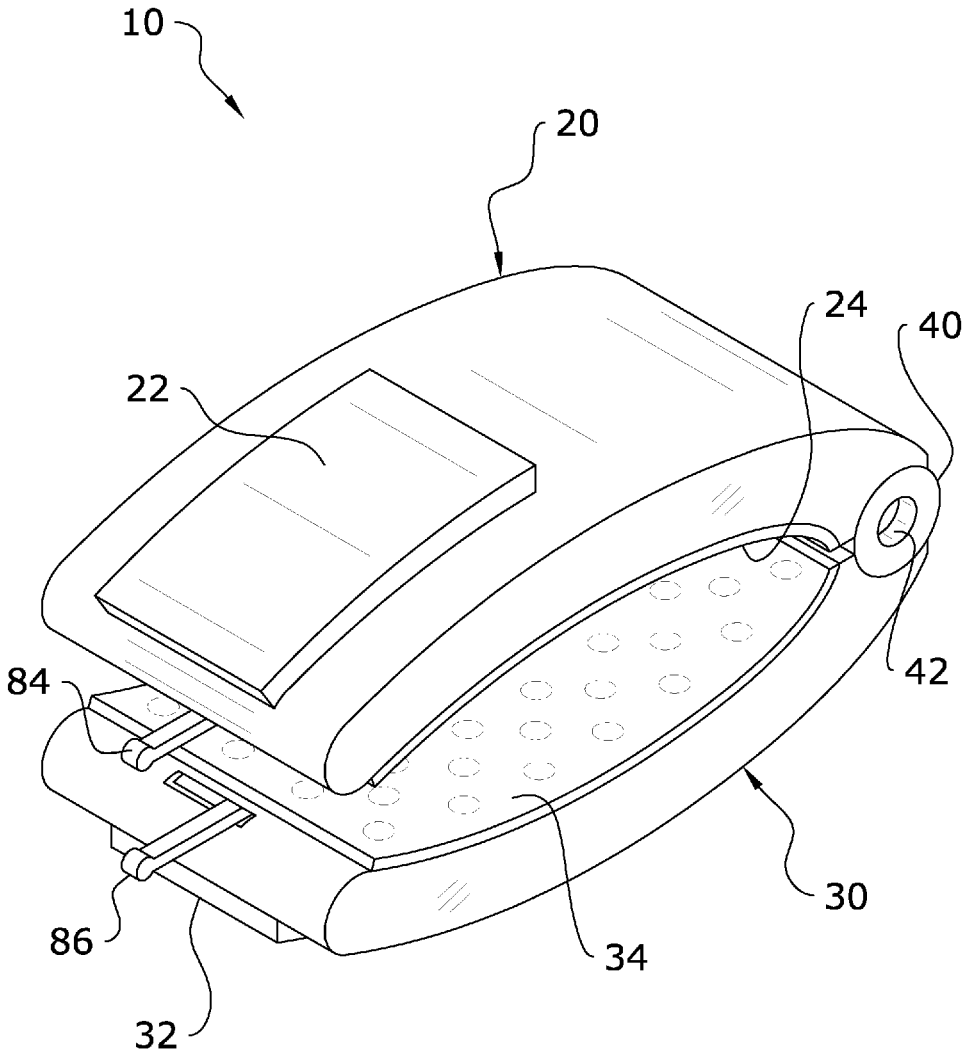
FIG. 11 is an upper perspective view of the second alternative embodiment illustrating the first lever and the second lever used to control the position of the first control plate and the second control plate respectively.

FIGS. 9 through 11 illustrate a second alternative embodiment utilized to control the flow of the liquid sanitizer through the apertures 28, 38. FIG. 9 is an end cutaway view illustrating a second alternative embodiment in a closed state utilizing a first control plate and a second slide plate slidably controlling flow of liquid sanitizer through the first apertures and second apertures respectively. As shown in FIGS. 9 and 10 of the drawings, a pair of first guides 21 extending along the interior length of the first dispenser 20 slidably and movably receive the first control plate 80 while retaining the first control plate 80 adjacent to the inner surface of the first reservoir 26. As shown in FIGS. 9 and 10 of the drawings, a pair of second guides 31 extending along the interior length of the second dispenser 30 slidably and movably receive the second control plate 82 while retaining the second control plate 82 adjacent to the inner surface of the second reservoir 36. The first control plate 80 and the second control plate 82 preferably include first control apertures 81 and second control apertures 83 respectively to selectively allow liquid sanitizer to pass through when desired and into the apertures 28, 38. As shown in FIG. 9, the liquid sanitizer is unable to flow through the apertures 28, 38 because the control plates 80, 82 are aligned so that the control apertures 81, 83 within the control plates 80, 82 are not aligned with the first apertures 28 or the second apertures 38. FIG. 10 is an end cutaway view illustrating the second alternative embodiment in an open state allowing the liquid sanitizer to flow through the first apertures 28 and second apertures 38. In the open state shown in FIG. 10, the control plates 80, 82 are moved so as to align the control apertures 81, 83 with the apertures 28, 38 within the dispensers 20, 30 respectively. FIG. 11 is an upper perspective view of the second alternative embodiment illustrating the first lever 84 and the second lever 86 used to control the position of the first control plate 80 and the second control plate 82 respectively. The levers 84, 86 extend outwardly from sealed slots within the dispensers 20, 30 to prevent leakage of the liquid sanitizer.

Figure 12:
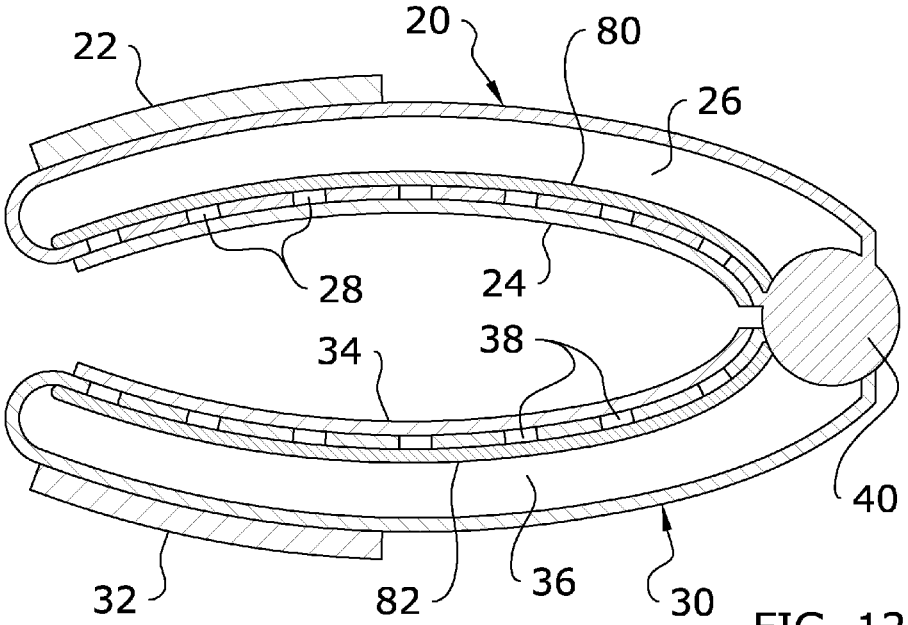
FIG. 12 is a side cutaway view of a third alternative embodiment illustrating the first control plate and the second control plate adjacent to the inner surfaces of the reservoirs to prevent the flow of liquid sanitizer through the apertures.
Figure 13:
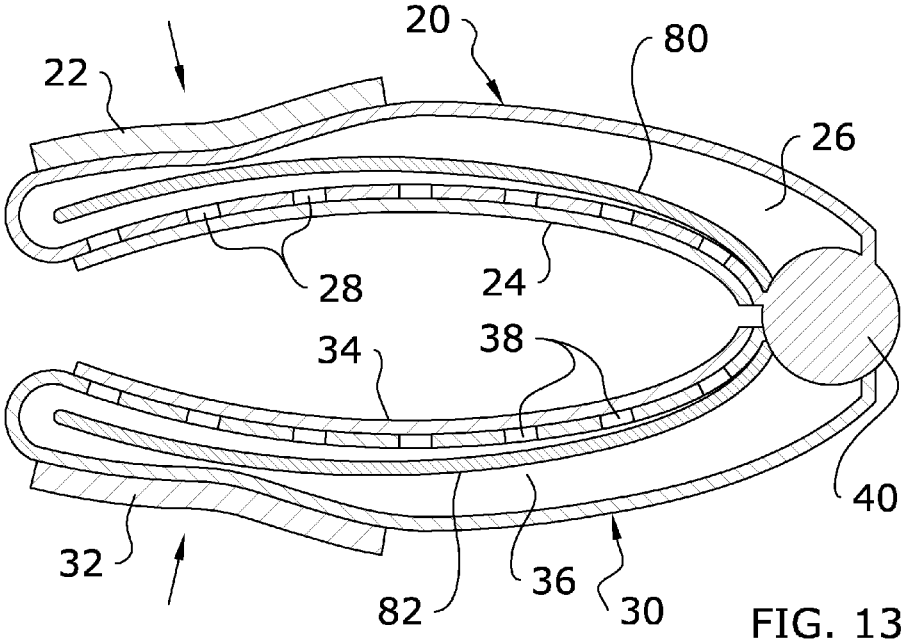
FIG. 13 is a side cutaway view of the third alternative embodiment illustrating the grips depressed resulting in the control plates being removed from the inner surfaces of the reservoirs and allowing the liquid sanitizer to flow through the apertures to the porous material.

FIG. 12 is a side cutaway view of a third alternative embodiment illustrating the first control plate 80 and the second control plate 82 attached to the hinge 40. When no pressure is applied to the dispensers 20, 30, the control plates 80, 82 are positioned adjacent to the inner surfaces of the reservoirs 26, 36 to prevent the flow of liquid sanitizer through the apertures. FIG. 13 is a side cutaway view of the third alternative embodiment illustrating the grips 22, 32 depressed resulting in the control plates 80, 82 being removed from the inner surfaces of the reservoirs 26, 36 and allowing the liquid sanitizer to flow through the apertures 28, 38 within the dispensers 20, 30 to the porous material.

H. Operation of Preferred Embodiment

In use, the user fills the reservoirs 26, 36 with a liquid sanitizer as desired. Though not required, the user may then connect the clip 70 to their body and the extending/retracting device 60 retains the dispensers 20, 30 in a storage position until the user requires usage of the present invention. When the user grasps the dispensers 20, 30, the biased tether 62 is released in a controlled manner and the tether 62 is of sufficient length to allow the user to freely utilize the dispensers 20, 30 to clean and/or sanitize a surface of an object (e.g. doorknob, table surface, hands, body parts, etc.). The user then applies pressure to the dispensers 20, 30 which in turn applies pressure within the reservoirs 26, 36 thereby causing the liquid sanitizer to be dispensed outwardly via the apertures 28, 38 of the dispensers 20, 30 into their respective porous material 24, 34. The liquid sanitizer is then applied to the object by the contact of the porous material 24, 34 to the object to be cleaned and/or sanitized. This process continues until the object is cleaned and/or sanitized as desired.

Figure 7:
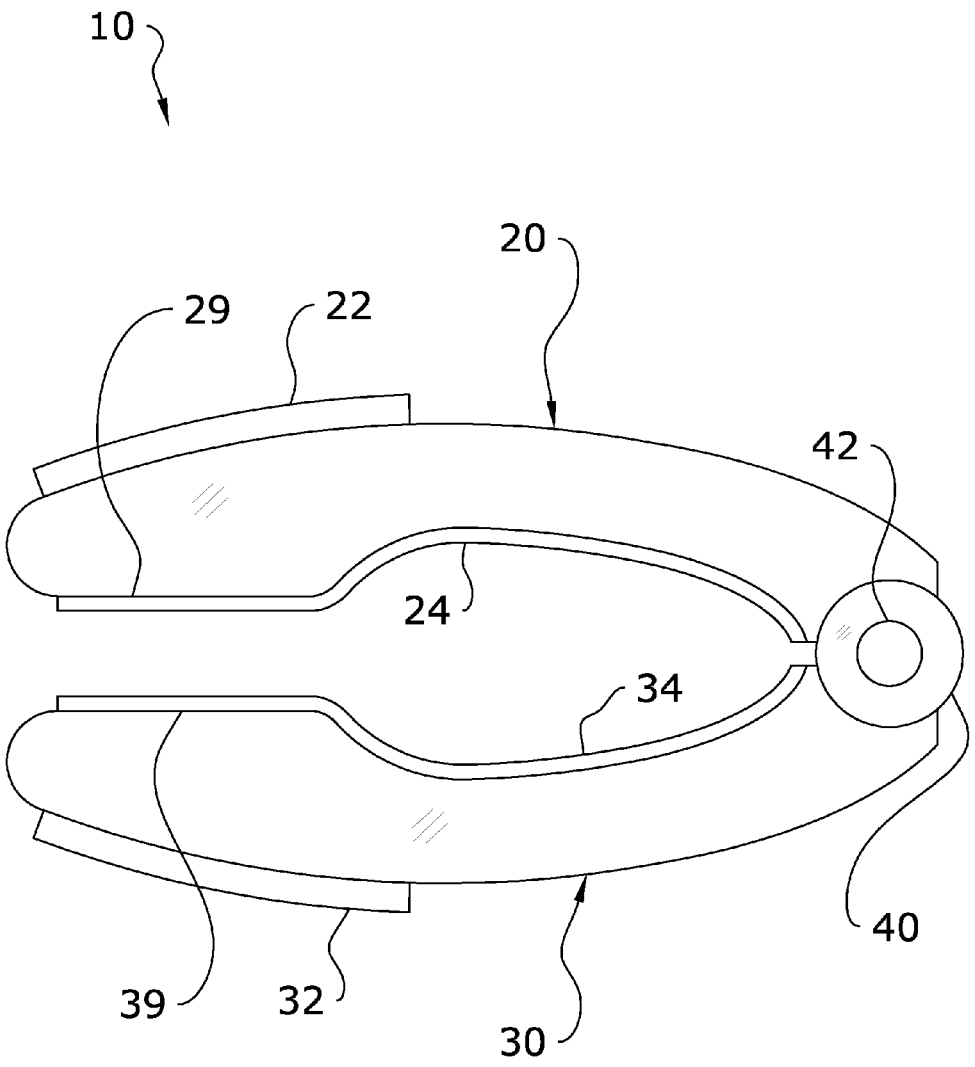
FIG. 7 is a side view of a first alternative embodiment of the present invention including opposing flat portions.

When in the open position as illustrated in FIG. 3 of the drawings, the present invention is in a substantially flat state that allows for cleaning and/or sanitizing of flat surfaces such as a table top. The resiliency of the dispensers 20, 30 allows for flattening of the dispensers 20, 30 so that a significant portion of the porous material 24, 34 makes contact with the flat surface. FIGS. 7 and 8 illustrate a preferred embodiment for flat surfaces with the flat portions 29, 39 that increase the contact with the flat surface.

When in the closed position as illustrated in FIG. 4 of the drawings, the present invention is in a substantially clam shaped or U-shaped state that allows for positioning around non-flat objects such as a doorknob. The user is able to engage the doorknob with the inner surfaces of the dispensers 20, 30 to clean and/or sanitize the doorknobs. Alternatively, the user may utilize the dispensers 20, 30 to open a door without having to make direct physical contact with the doorknob with their hands.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above.

All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive.

Any headings utilized within the description are for convenience only and have no legal or limiting effect.

The invention claimed is:

1. A liquid sanitizer dispenser system, comprising:

a first dispenser including a first reservoir for storing a volume of liquid sanitizer, a first inner surface and a plurality of first apertures extending through said first inner surface to said first reservoir;

a second dispenser including a second reservoir for storing a volume of liquid sanitizer, a second inner surface and a plurality of second apertures extending through said second inner surface to said second reservoir;

wherein said first dispenser is pivotally connected to said second dispenser to provide for an open position and a closed position;

wherein said first dispenser is pivotally connected to said second dispenser by a hinge connected between said first dispenser and said second dispenser; and a refill aperture within said hinge, wherein said refill aperture is fluidly connected to said first reservoir and said second reservoir for refilling said reservoirs with liquid sanitizer.

2. The liquid sanitizer dispenser system of claim 1, wherein said hinge is biased to retain said dispensers in said open position in a biased manner.

3. The liquid sanitizer dispenser system of claim 1, wherein said open position is comprised of said first dispenser extending away from said second dispenser and wherein said closed position is comprised of said first dispenser opposing said second dispenser in a substantially parallel manner.

4. The liquid sanitizer dispenser system of claim 1, wherein said first dispenser and said second dispenser are each comprised of a curved structure.

5. The liquid sanitizer dispenser system of claim 4, wherein said first dispenser includes a first flat portion and said second dispenser includes a second flat portion.

6. The liquid sanitizer dispenser system of claim 5, wherein said first flat portion and said second flat portion are within end portions of said dispensers opposite of the area of pivot connection.

7. The liquid sanitizer dispenser system of claim 1, including a first grip attached to a first outer surface of said first dispenser and a second grip attached to a second outer surface of said second dispenser.

8. The liquid sanitizer dispenser system of claim 1, including a first porous material attached to said first inner surface of said first dispenser and a second porous material attached to said second inner surface of said second dispenser.

9. A liquid sanitizer dispenser system, comprising:

a first dispenser including a first reservoir for storing a volume of liquid sanitizer, a first inner surface and a plurality of first apertures extending through said first inner surface to said first reservoir;

a second dispenser including a second reservoir for storing a volume of liquid sanitizer, a second inner surface and a plurality of second apertures extending through said second inner surface to said second reservoir;

wherein said first dispenser is pivotally connected to said second dispenser by a hinge connected between said first dispenser and said second dispenser to provide for an open position and a closed position;

a first porous material attached to said first inner surface of said first dispenser;

a second porous material attached to said second inner surface of said second dispenser;

a means for controlling a flow of liquid sanitizer through said first apertures;

a means for controlling a flow of liquid sanitizer through said second apertures; and a refill aperture within said hinge, wherein said refill aperture is fluidly connected to said first reservoir and said second reservoir for refilling said reservoirs with liquid sanitizer.

10. The liquid sanitizer dispenser system of claim 9, wherein said hinge is biased to retain said dispensers in said open position in a biased manner.

11. The liquid sanitizer dispenser system of claim 10, an extending/retracting device including a tether retractably extending therefrom, wherein said tether is connected to either said first dispenser or said second dispenser.

12. The liquid sanitizer dispenser system of claim 9, wherein said open position is comprised of said first dispenser extending away from said second dispenser.

13. The liquid sanitizer dispenser system of claim 9, wherein said closed position is comprised of said first dispenser opposing said second dispenser in a substantially parallel manner.

14. The liquid sanitizer dispenser system of claim 9, wherein said first dispenser and said second dispenser are each comprised of a curved structure.

15. The liquid sanitizer dispenser system of claim 14, wherein said first dispenser includes a first flat portion and said second dispenser includes a second flat portion.

16. The liquid sanitizer dispenser system of claim 15, wherein said first flat portion and said second flat portion are within end portions of said dispensers opposite of the area of pivot connection.

17. The liquid sanitizer dispenser system of claim 9, including a first grip attached to a first outer surface of said first dispenser and a second grip attached to a second outer surface of said second dispenser.

18. A liquid sanitizer dispenser system, comprising:

a first dispenser including a first reservoir for storing a volume of liquid sanitizer, a first inner surface and a plurality of first apertures extending through said first inner surface to said first reservoir;

a second dispenser including a second reservoir for storing a volume of liquid sanitizer, a second inner surface and a plurality of second apertures extending through said second inner surface to said second reservoir;

wherein said first dispenser and said second dispenser are each comprised of a curved structure;

wherein said first dispenser includes a first flat portion and said second dispenser includes a second flat portion;

wherein said first flat portion and said second flat portion are within end portions of said dispensers opposite of said hinge;

wherein said first dispenser is pivotally connected to said second dispenser to provide for an open position and a closed position;

wherein said first dispenser is pivotally connected to said second dispenser by a hinge connected between said first dispenser and said second dispenser;

wherein said hinge is biased to retain said dispensers in said open position in a biased manner;

wherein said open position is comprised of said first dispenser extending away from said second dispenser and wherein said closed position is comprised of said first dispenser opposing said second dispenser in a substantially parallel manner;

a refill aperture within said hinge, wherein said refill aperture is fluidly connected to said first reservoir and said second reservoir for refilling said reservoirs with liquid sanitizer;

a first porous material attached to said first inner surface of said first dispenser;

a second porous material attached to said second inner surface of said second dispenser;

a connecting member attached to either said first dispenser or said second dispenser;

an extending/retracting device including a tether retractably extending therefrom, wherein said tether is connected to said connecting member;

a clip attached to said extending/retracting device; and a first grip attached to a first outer surface of said first dispenser and a second grip attached to a second outer surface of said second dispenser;

a means for controlling a flow of liquid sanitizer through said first apertures; and a means for controlling a flow of liquid sanitizer through said second apertures.

* * * * *